US009387140B2

(12) United States Patent
Tekulve

(10) Patent No.: US 9,387,140 B2
(45) **Date of Patent: *Jul. 12, 2016**

(54) HEALTH CARE BED WITH VARIABLE WIDTH BED FRAME AND METHOD FOR USE THEREOF

(71) Applicant: Med-Mizer, Inc., Batesville, IN (US)

(72) Inventor: Daniel R. Tekulve, Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/692,450

(22) Filed: Apr. 21, 2015

(65) Prior Publication Data

US 2015/0297430 A1 Oct. 22, 2015

Related U.S. Application Data

(63) Continuation of application No. 13/363,372, filed on Jan. 31, 2012, now Pat. No. 9,009,888, which is a continuation-in-part of application No. 29/359,608, filed on Apr. 13, 2010, now Pat. No. Des. 653,047.

(51) Int. Cl.
*A61G 7/015* (2006.01)
*A47C 19/04* (2006.01)
(Continued)

(52) U.S. Cl.
CPC ..... *A61G 7/015* (2013.01); *A47C 19/04* (2013.01); *A61G 7/002* (2013.01); *A61G 13/129* (2013.01)

(58) Field of Classification Search
CPC ..... A47C 17/76; A47C 19/04; A47C 20/023; A47D 7/01; A61G 7/002; A61G 7/015; A61G 7/0525; A61G 7/075; A61G 13/129
USPC ..... 5/175, 181, 183, 184, 185, 202
See application file for complete search history.

(56) References Cited

U.S. PATENT DOCUMENTS 1,096,760 A 5/1914 Rudolph
4,669,136 A 6/1987 Waters et al.
(Continued)

FOREIGN PATENT DOCUMENTS

EP 2208443 A1 7/2010

OTHER PUBLICATIONS

Med-Mizer Retractabed brochure, published 2007, 2 pages.

*Primary Examiner* — Nicholas Polito
(74) *Attorney, Agent, or Firm* — R. Randall Frisk

(57) ABSTRACT

A method for varying the width of a health care bed includes providing a health care bed having a floor engaging base frame and a bed frame, the bed frame including at least two bed sections hingedly connected to each other and each having a central frame portion and left and right wing sections, the wing sections having at least a retracted position and an extended position relative to the central frame portion, and wherein the central frame portion defines, for each wing section, at least inner and outer registration holes and the wing sections each define at least one wing hole that aligns with one of the at least inner and outer registration holes when the wing sections are in the respective retracted and extended positions, and for each wing section, at least one locking mechanism having at least one rocker bar with opposing inner and outer ends, at least one spring and at least one locking button for releasably locking the wing sections in the retracted and extended positions; unlocking the at least one locking mechanism of one of the wing sections by pushing the outer end of its rocker bar to move the opposing inner end and one of the locking buttons out of engagement with a corresponding and then aligned registration hole and wing hole; and then moving the one wing section to the desired extended or retracted position.

20 Claims, 14 Drawing Sheets

(51) Int. Cl.
*A61G 7/002* (2006.01)
*A61G 13/12* (2006.01)

(56) References Cited

U.S. PATENT DOCUMENTS

| | | | | |
|---|---|---|---|---|
| 5,377,370 | A | 1/1995 | Foster et al. | |
| D371,467 | S | 7/1996 | Biefnot et al. | |
| D437,143 | S | 2/2001 | Sommerfeld | |
| 6,578,216 | B1 | 6/2003 | Aarestad | |
| 7,478,447 | B2 | 1/2009 | Wilming et al. | |
| D616,666 | S | 6/2010 | Rizzardo | |
| 7,730,562 | B2 | 6/2010 | Hornbach et al. | |
| 7,743,441 | B2 | 6/2010 | Poulos et al. | |
| D653,047 | S | 1/2012 | Tekulve | |
| 8,220,086 | B2 | 7/2012 | Geiger | |
| 9,009,888 | B1 * | 4/2015 | Tekulve | 5/181 |
| 2005/0091747 | A1 | 5/2005 | Freeborn et al. | |
| 2006/0253983 | A1 | 11/2006 | Falabrino | |
| 2008/0168602 | A1 | 7/2008 | DiForio | |

* cited by examiner

HEALTH CARE BED WITH VARIABLE WIDTH BED FRAME AND METHOD FOR USE THEREOF

REFERENCE TO RELATED APPLICATIONS

This application is a continuation of and claims the benefit of U.S. application Ser. No. 13/363,372, filed Jan. 31, 2012, which is a continuation-in-part of U.S. patent application Ser. No. 29/359,608 filed Apr. 13, 2010, now Pat. No. D653,047, issued Jan. 31, 2012, which applications and patent are hereby incorporated by reference in their entireties.

FIELD OF THE INVENTION

The present invention relates to the field of health care beds, and more specifically, to a health care bed with a variably sized bed frame and a method for use thereof.

BACKGROUND OF THE INVENTION

Bed frames for home, nursing and hospital healthcare environments are generally designed with bed frames about 35 inches wide, which will accommodate most persons. For large persons, persons suffering from obesity and persons having other afflictions wherein a wider bed frame can be beneficial, bariatric beds are provided with bed frames having widths such as 39, 42 or even 48 inches or wider.

What is needed is a health care bed operable to readily transform between two or more widths.

SUMMARY OF THE INVENTION

Generally speaking, a health care bed includes a bed frame having at least at least two bed sections hingedly connected to each other and each having a central frame portion and left and right wing sections where the wing sections can be moved between retracted and extended positions to vary the width of the bed section.

A method for varying the width of a health care bed includes providing a health care bed having a floor engaging base frame and a bed frame, the bed frame including at least two bed sections hingedly connected to each other and having a central frame portion and left and right wing sections, the wing sections having at least a retracted position and an extended position relative to the central frame portion, and wherein the central frame portion defines, for each wing section, at least inner and outer registration holes and the wing sections each define at least one wing hole that aligns with one of the at least inner and outer registration holes when the wing sections are in the respective retracted and extended positions, and for each wing section, at least one locking mechanism having at least one rocker bar with opposing inner and outer ends, at least one spring and at least one locking button for releasably locking the wing sections in the retracted and extended positions; unlocking the at least one locking mechanism of one of the wing sections by pushing the outer end of its rocker bar to move the opposing inner end and one of the locking buttons out of engagement with a corresponding and then aligned registration hole and wing hole; and then moving the one wing section to the desired extended or retracted position.

Figure 20A:
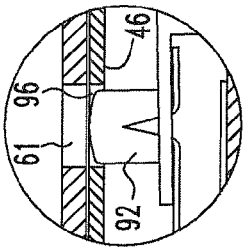
FIG. 20 is a cross-sectional view of the corner of the back section 12 of FIG. 18 and shown with knob 103 depressed to release locking button 92.
Figure 20:
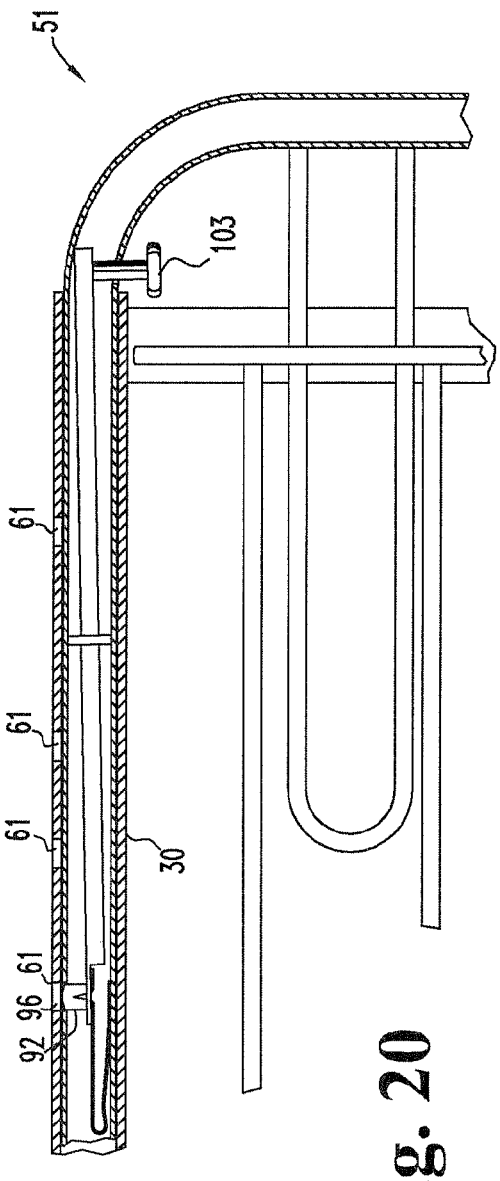

FIG. **20*a* is an enlarged portion of the cross-sectional view of the corner of the back section 12 of FIG. 20 showing the locking button 92 and corresponding holes 61 and 96**.

Figure 18:
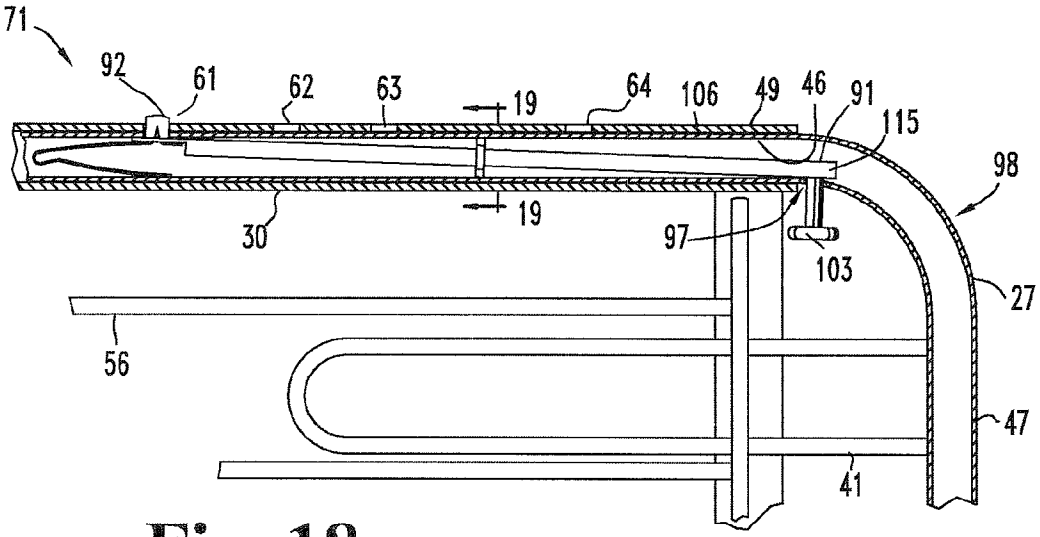
FIG. 18 is a cross-sectional view of a corner of the back section 12 of the bed frame 10 of FIG. 5, taken along the lines 18-18 and viewed in the direction of the arrows.
Figure 21:
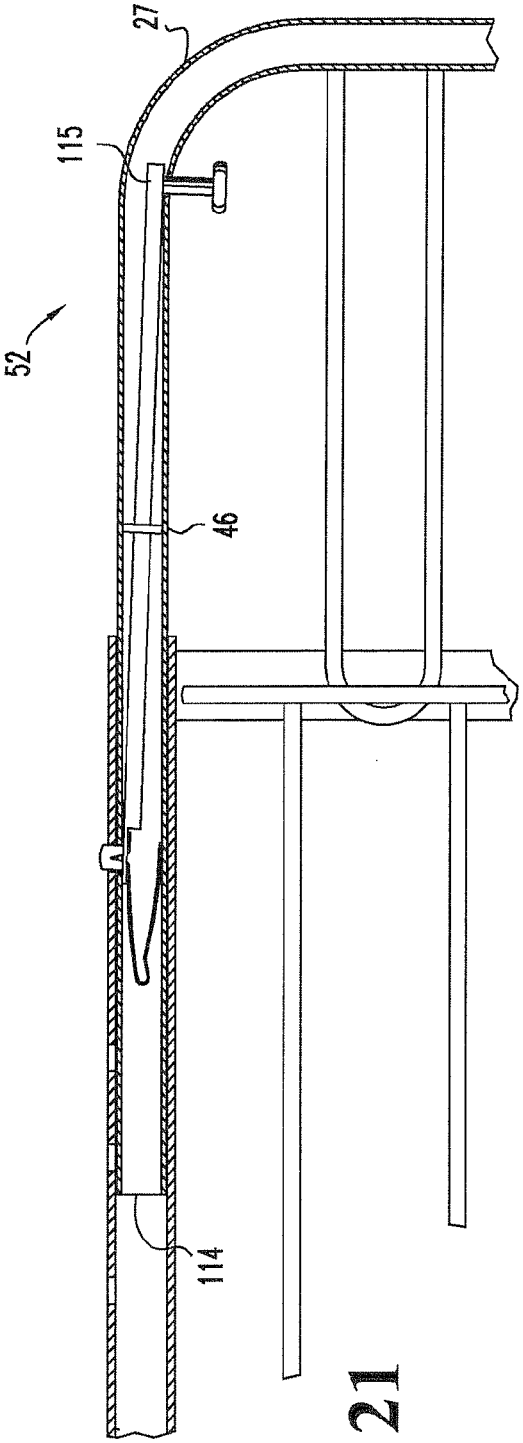

FIG. 21 is a cross-sectional view of the corner of the back section 12 of FIG. 18 and shown with wing section 27 in the fully extended position 52.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Referring to FIGS. 1-14 there is shown a health care bed frame 10 with variable width framing. Bed frame 10 generally includes a back section 12, a seat section 13, an upper leg section 14, a lower leg section 15, and a locking assembly (designated at 16) for releasably holding bed frame 10 in one of its varied width positions. Sections 12-15 are pivotally interconnected along parallel, horizontal axes 21, 22 and 23, as shown, to enable bed frame 10 to be articulated between a fully reclined position 5 (shown in FIG. 15) and a fully inclined position 7 (shown in FIG. 16), as well as a variety of positions in between. As used herein, front, forward and forwardly refer toward the foot and lower leg section 15 of bed frame 10, and rear, rearward and rearwardly refer toward the head and back section 12 of bed frame 10.

Figure 1:
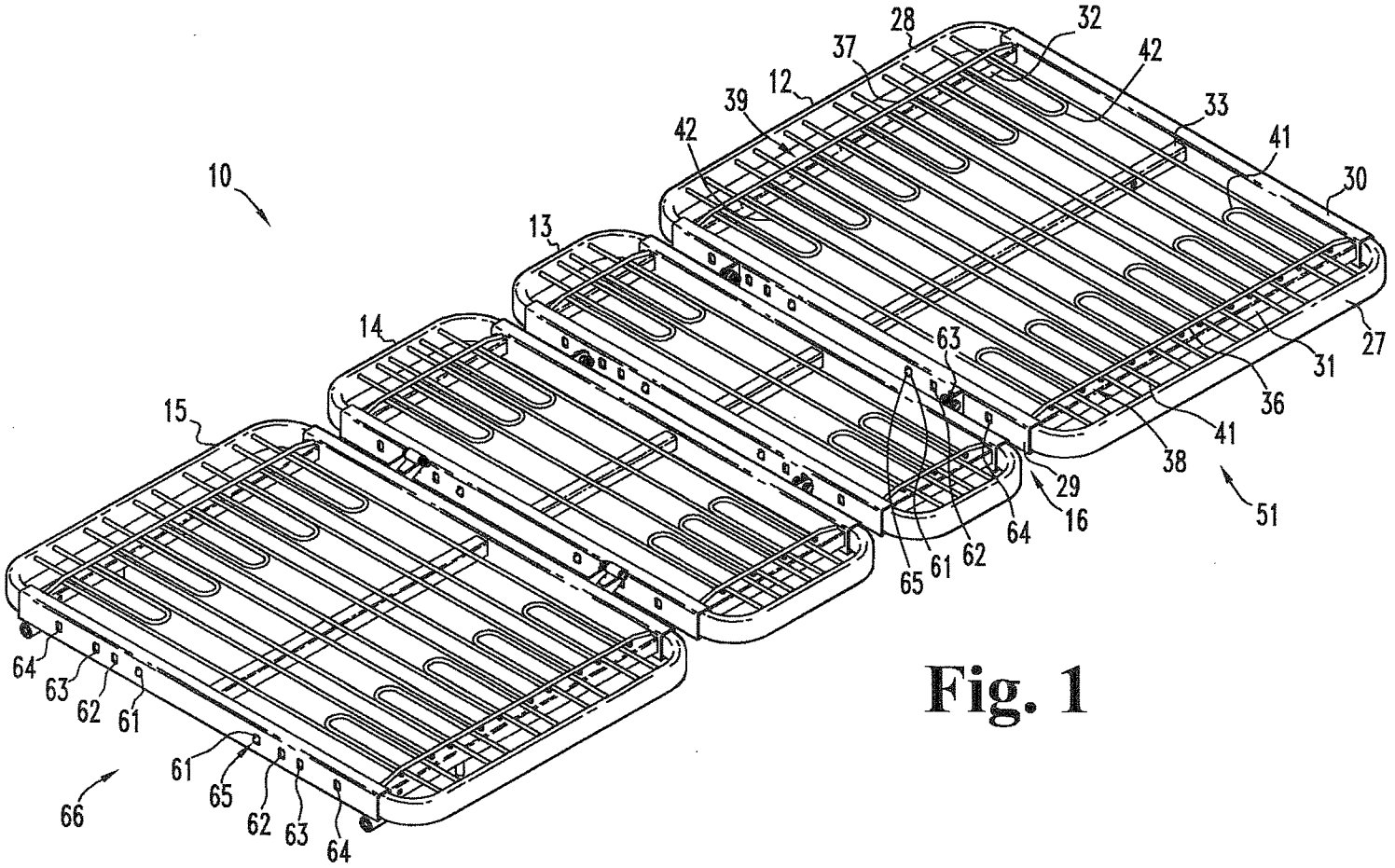
FIG. 1 is a perspective view of a health care bed 10 in accordance with the present invention, with variable width framing and shown in the retracted position 51.
Figure 2:
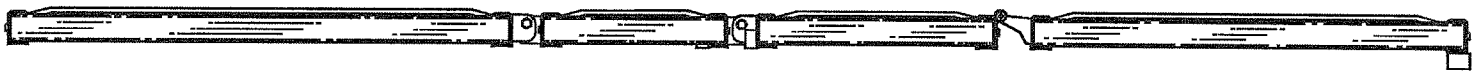
FIG. 2 is a left side view of the health care bed 10 of FIG. 1.
Figure 3:
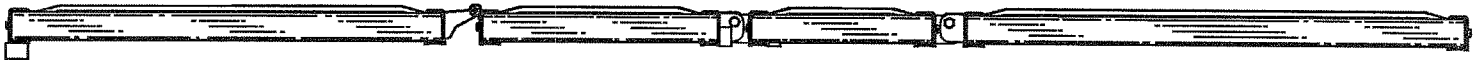
FIG. 3 is a right side view of the health care bed 10 of FIG. 1.
Figure 4:
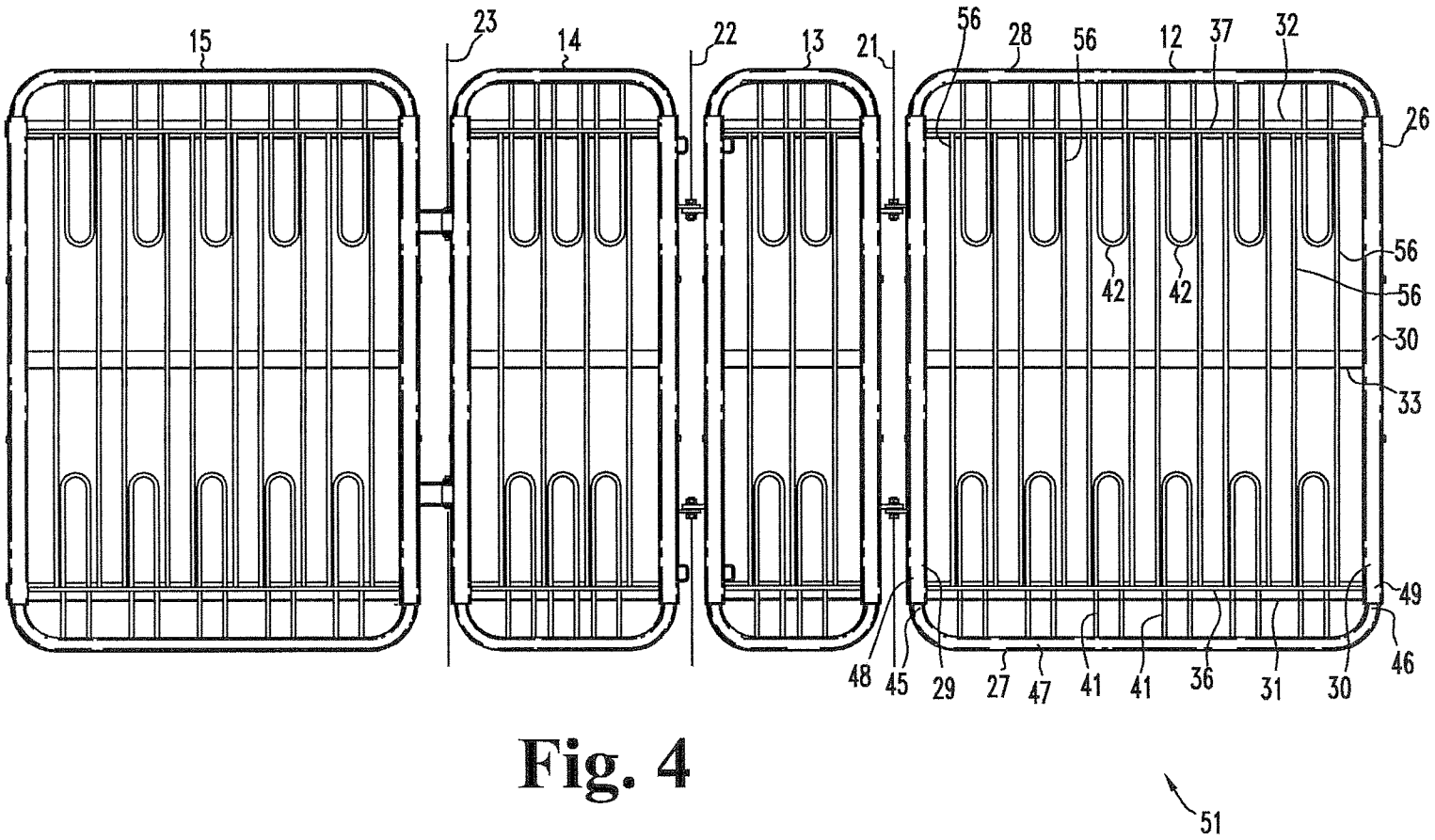
FIG. 4 is a top view of the health care bed 10 of FIG. 1.
Figure 5:
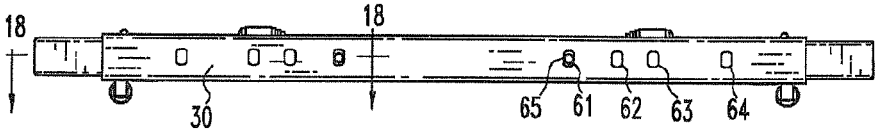
FIG. 5 is a head end view of the health care bed 10 of FIG. 1.
Figure 6:
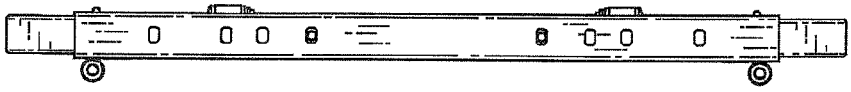
FIG. 6 is a foot end view of the health care bed 10 of FIG. 1.
Figure 7:
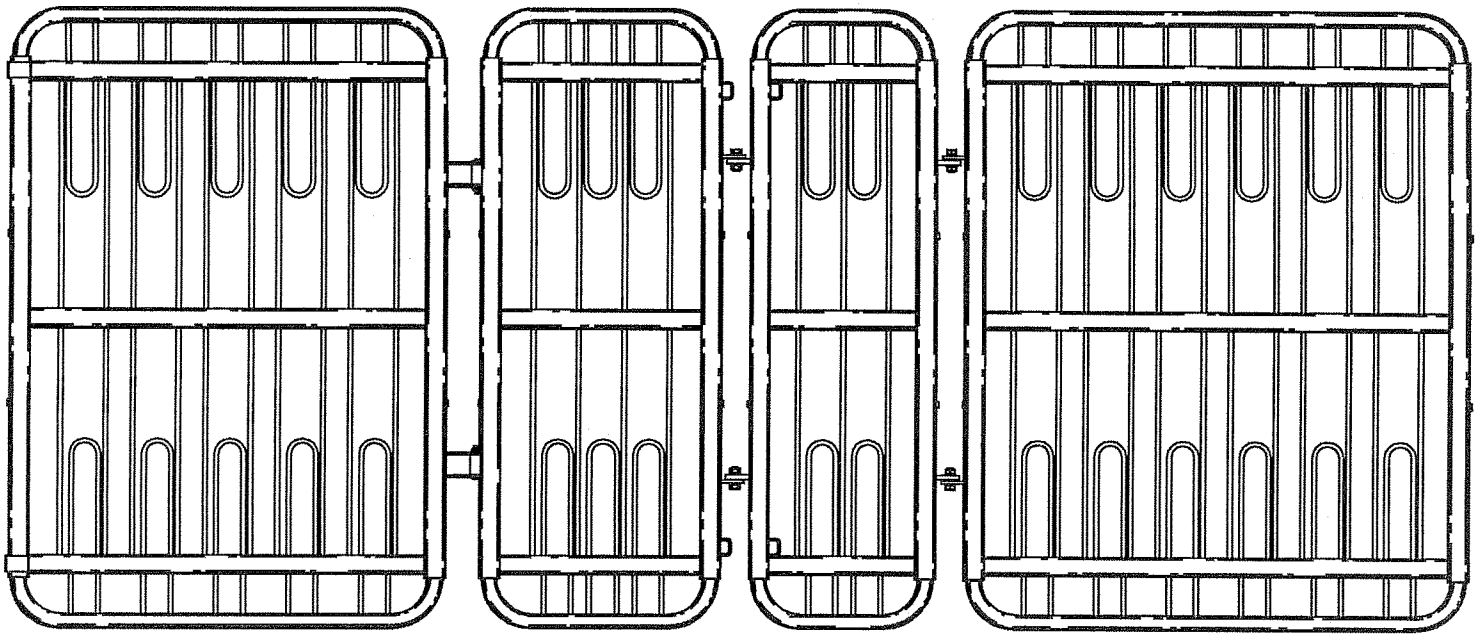
FIG. 7 is a bottom view of the health care bed 10 of FIG. 1.

The following description refers to back section 12, it being understood that the other sections 13-15 are similarly structured as it relates to the structure and operation of the wing sections and locking mechanisms described herein. Referring to FIGS. 1 and 4, back section 12 includes a central frame portion 26 and left and right side frames or wing sections 27 and 28, respectively, that are connected for horizontal extension and retraction relative central frame portion 26, as described herein. Central frame portion 26 includes forward and rearward, mutually parallel tube members 29 and 30 that are rigidly interconnected by left and right longitudinal frame rails 31 and 32 and, if desired, one or more additional longitudinal or similar structural support members, such as middle support rail 33. Tube members 29 and 30 each define a longitudinal cavity along its length sized and configured to telescopically receive mating arms of left and right wing sections, as described. Back section 12 also includes left and right upper slide retention rails 36 and 37, which extend between forward and rearward tube members 29 and 30 and above a corresponding one of left and right longitudinal frame rails 31 and 32. Slide gaps 38 and 39 are thus formed between upper retention rails 36 and 37 and their underlying frame rails 31 and 32, respectively, the slide gaps 38 and 39 being of a sufficient height to slidingly receive the series of inwardly extending tongues 41 and 42 of left and right wing sections 27 and 28, as shown.

Figure 8:
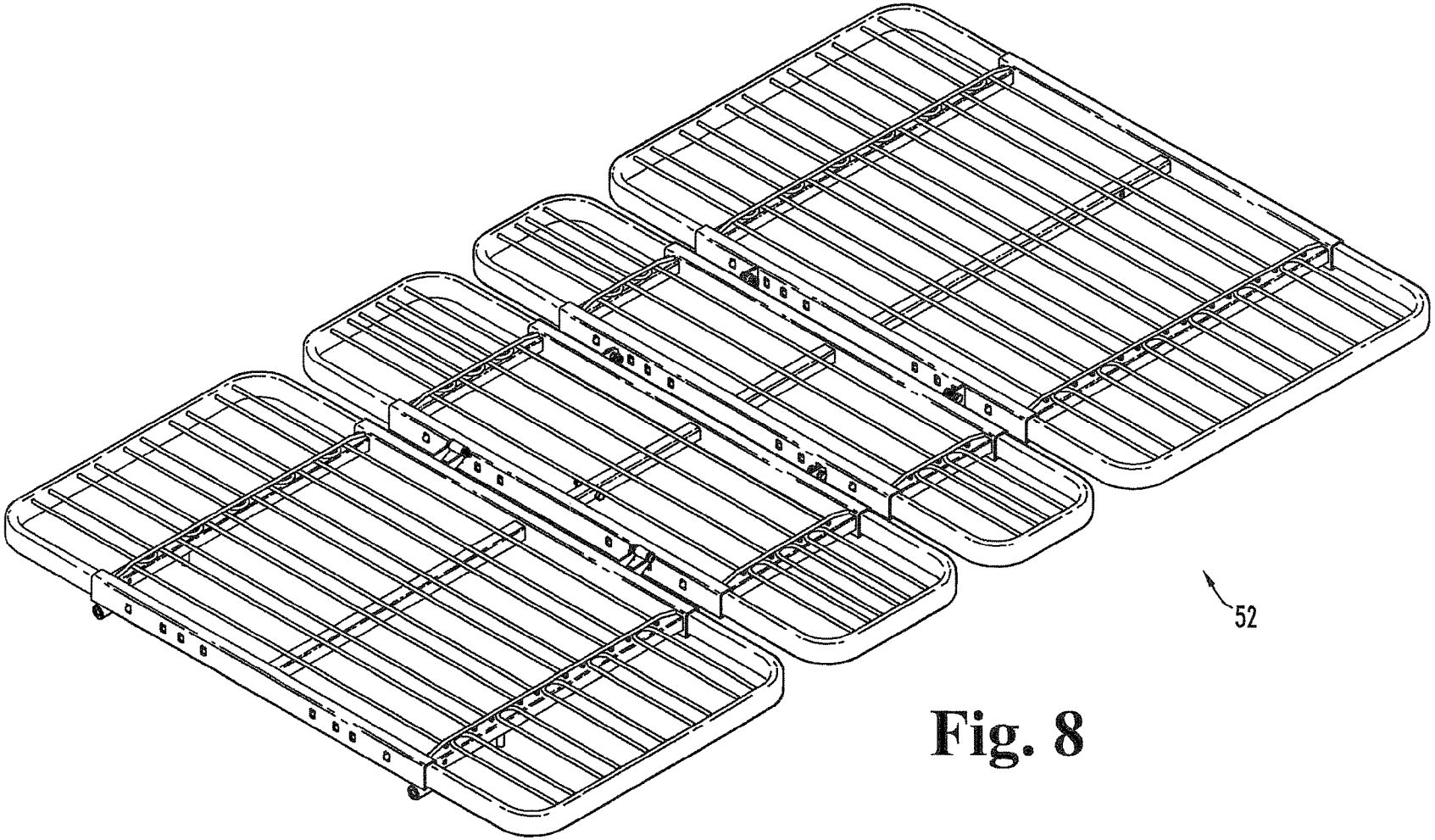
FIG. 8 is a perspective view of the health care bed 10 of FIG. 1 and shown in the fully extended position 52.
Figure 9:
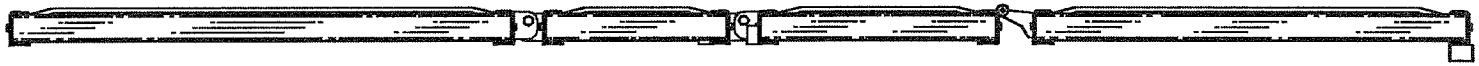
FIG. 9 is a left side view of the health care bed 10 of FIG. 8.
Figure 10:
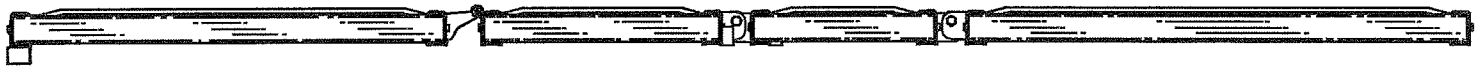
FIG. 10 is a right side view of the health care bed 10 of FIG. 8.
Figure 11:
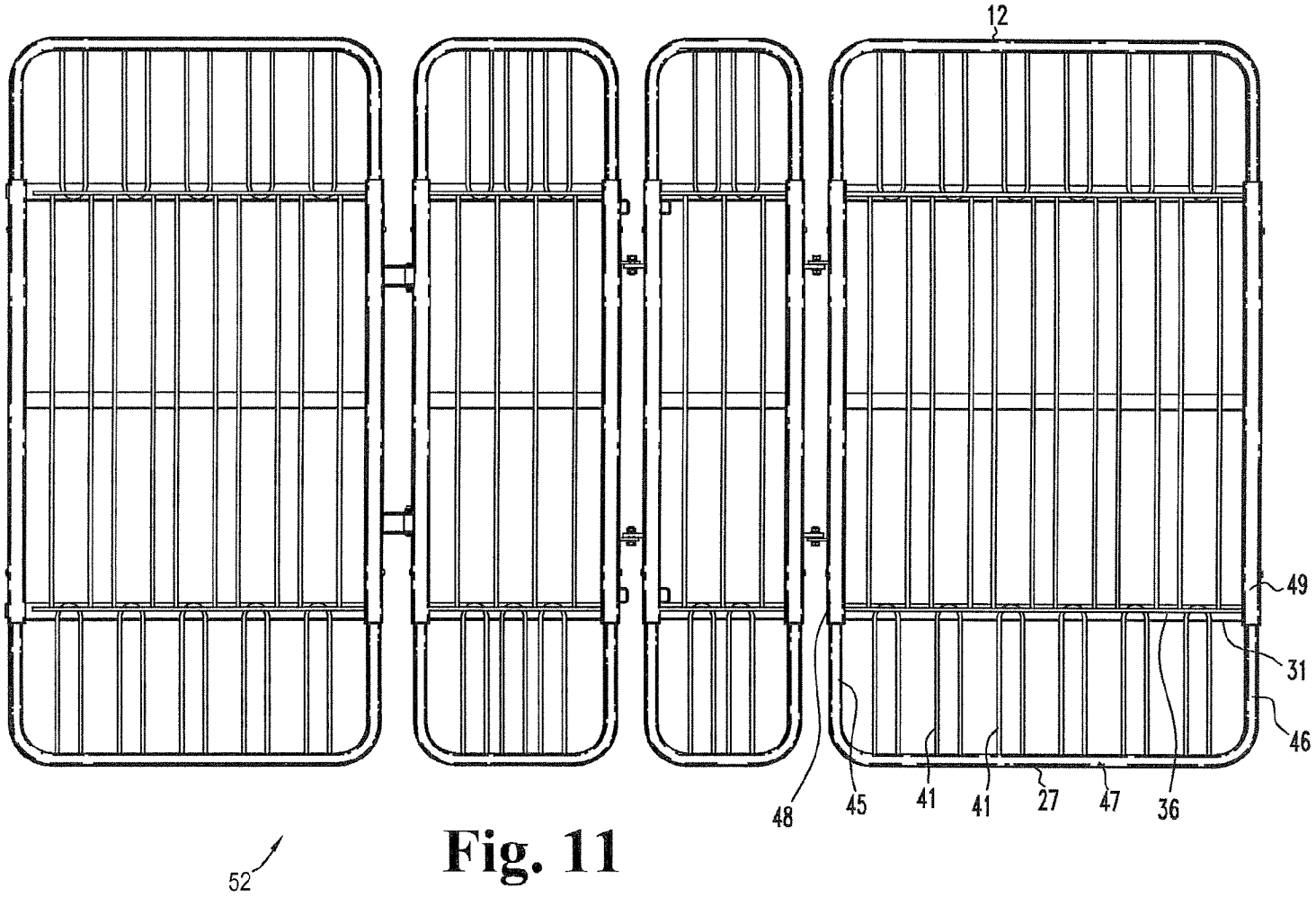
FIG. 11 is a top view of the health care bed 10 of FIG. 8.
Figure 12:
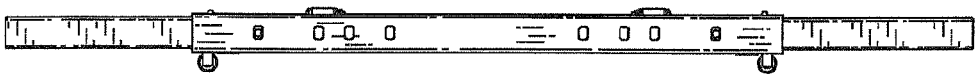
FIG. 12 is a head end view of the health care bed 10 of FIG. 8.
Figure 13:
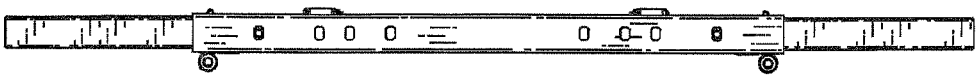
FIG. 13 is the foot end view of the health care bed 10 of FIG. 8.
Figure 14:
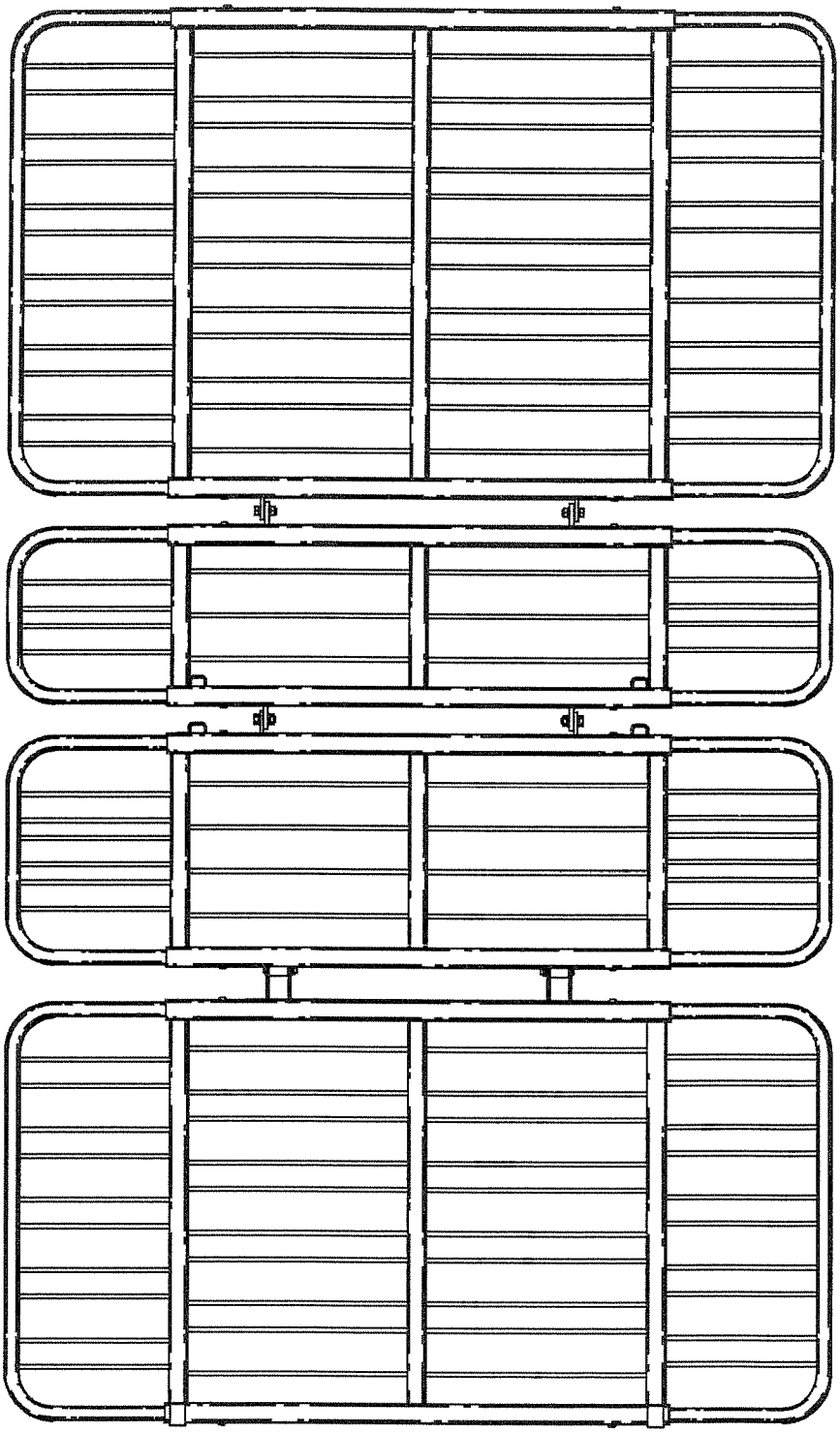
FIG. 14 is the bottom view of the health care bed 10 of FIG. 8.

Left and right wing sections 27 and 28 are mirror images of each other, and thus only wing section 27 will be described. Left wing section 27 is generally C-shaped, made of rectangular box tubing, which forms opposing arms 45 and 46 and a siderail 47 extending therebetween. At least a significant portion of the opposing arms 45 and 46 are sized and configured to be telescopically received within the mating cavities of tube members 29 and 30, at the outer ends thereof; the connecting siderail 47 could be alternatively sized or shaped. Thus, the arms 45 and 46 are telescopically received by tube members 29 and 30 at their left ends 48 and 49, respectively, and left wing section 27 can be moved between a retracted position 51 (FIGS. 1 and 4) and a fully extended position 52 (FIGS. 8 and 11).

Back section 12 also includes a series of spaced apart, mattress support rods 56 that are connected to the underside of and extend between opposing left and right upper slide retention rails 36 and 37. The mattress support rods 56 are also connected to and supported by the one or more additional support rail(s) 33. Left wing section 27 also includes the series of tongues 41 that extend inwardly from siderail 47, through slide gap 38 and substantially co-planar with mattress support rods 56. In the present embodiment, tongues 41 comprise the same small diameter rod as mattress support rods 56 and extend in a loop configuration from the siderail 47. Alternative embodiments are contemplated wherein any of the rails, arms, bars, etc. that comprise back section 12 are shaped, spaced, numbered and/or connected in ways different than described herein, except that the arms 45 and 46 of wing section 27 are telescopically received within the outer ends 48 and 49 of tube members 29 and 30. The lengths of tongues 41 are such that a portion of each tongue 41 resides within the slide gap 38 when wing section 27 is in its fully extended position 52, as shown in FIGS. 8 and 11.

Locking assembly 16 includes at least one locking mechanism 71, which comprises a series of registration holes 61-64 defined in each of forward and rearward tube members 29 and 30, as well as an arm hole (not shown) defined in each of the arms 45 and 46 of each wing section, and a locking button 65. Locking button 65 is located within each arm 45/46 at the hole (not shown) in such arm 45/46 and is biased (by a spring member, not shown) to extend outwardly of both the arm hole (not shown) in such arm 45/46 and one of the registration holes 61-65 of a corresponding tube member 29 and 30 with which it may be aligned. Thus, when in the fully retracted position 51 (FIG. 1), a locking button 65 extends from within arm 45, through the hole (not shown) of arm 45 and through the innermost hole 61 of tube member 29, and arm 45 and its left wing section 27 are thus locked with tube member 29 and its central frame portion 26 in the retracted position 51. Depressing such button, and the opposing button on the opposing tube member 30, moves the buttons 65 inwardly of the holes in the tube members 29 and 30, and the wing section 27 is free to slide outwardly until the buttons reach the next set of holes (62), and under spring bias, extend outwardly into the next set of holes to now lock wing member 27 in that position which, here, is one of two intermediated positions between the retracted and fully extended positions 51 and 52.

Figure 15:
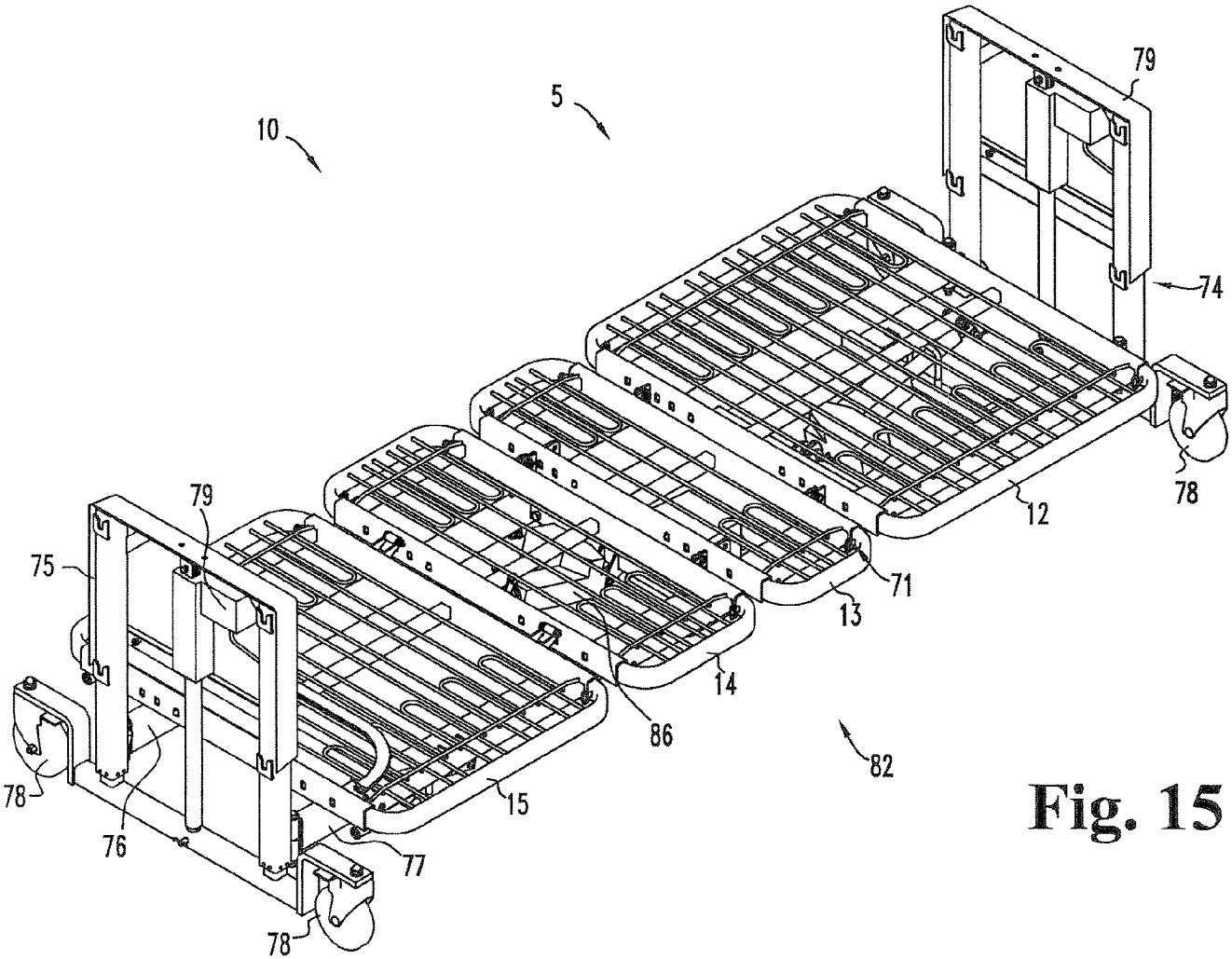
FIG. 15 is a perspective view of a health care bed 70 with variably sized bed frame 10 in accordance with the present invention and shown in the fully reclined position 5.
Figure 16:
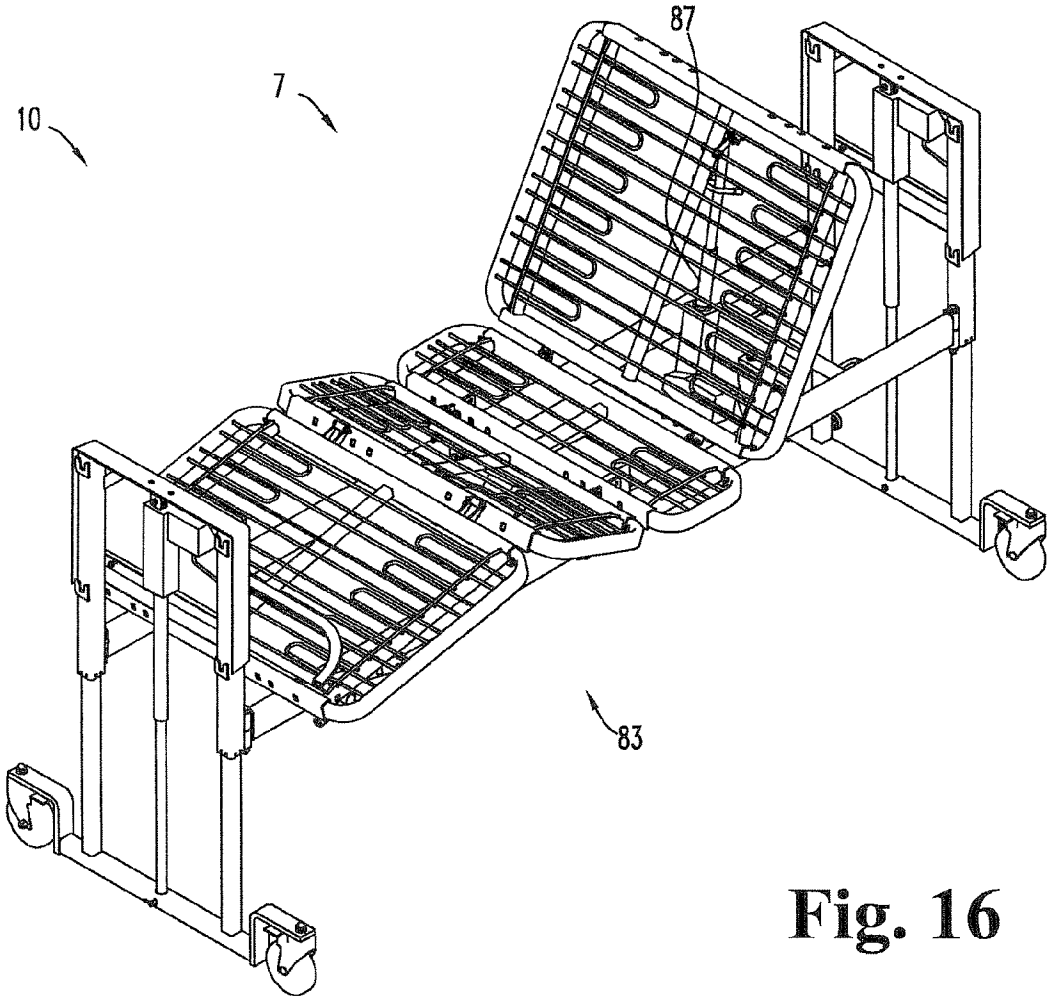
FIG. 16 is a perspective view of the health care bed 70 of FIG. 15 and shown in the fully inclined position 7.
Figure 17:
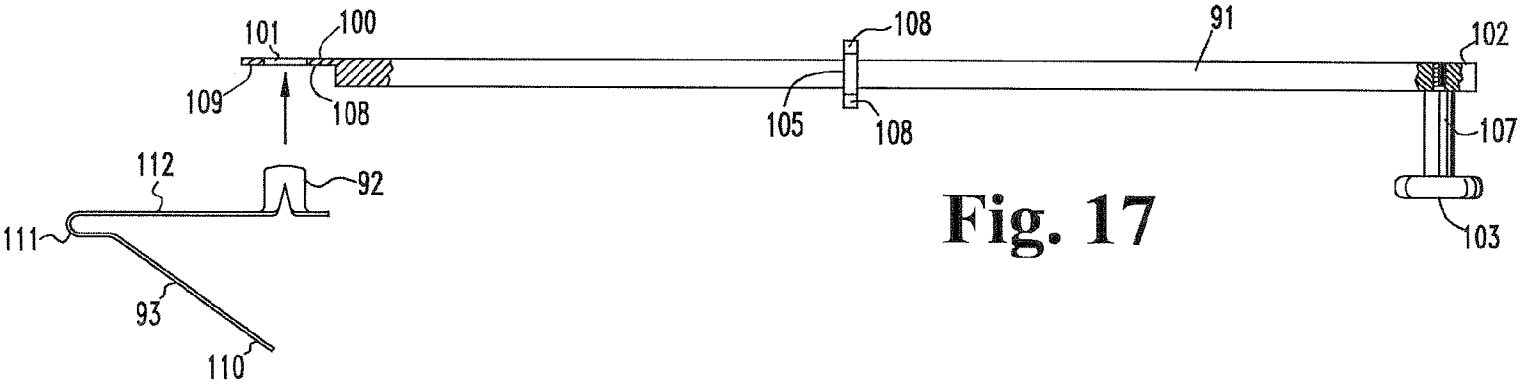
FIG. 17 is a plan view of a rocker bar 91, spring 93 and locking button 92 of a locking mechanism 71 of health care bed 70 of FIG. 15.
Figure 19:
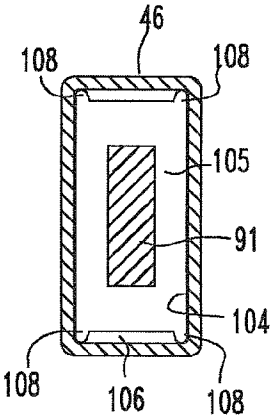
FIG. 19 is a cross-section of a portion of the back section 12 of FIG. 18, taken along the lines 19-19 and viewed in the direction of the arrows.

Referring to FIGS. 15 and 16, there is shown a health care bed 70 with variably sized health care bed frame 10 in accordance with the present invention. Health care bed 10 generally includes the bed frame 10 in substantially the same form as shown in FIGS. 1-14 and described, a base frame 12 and at least one locking mechanism 71 in accordance with another embodiment of the present invention. Base frame 12 includes head and foot stanchions 74 and 75, respectively, and one or more elongated frame rails 76 and 77 extending therebetween. Each stanchion includes floor engaging casters 78 to enable the bed 10 to be moved about the floor. Each stanchion is also provided with a lifting mechanism 79 or similar mechanism to permit mechanized raising and lowering of the frame rails 76/77 and the bed frame 10 mounted thereto between lowered and raised positions (FIGS. 15 and 16, respectively). Head, seat, upper leg and lower leg sections 12-15 are fixedly and/or movably mounted to the frame rails 76 and 77 to enable such sections 12-15 to be articulated between a flat, reclined position 82 and myriad articulated positions (such as at 83) via linear actuators (as at 86 and 87) connected between frame rails 76 and 77 and one or more of the head, seat, upper leg and lower leg sections 12-15.

Referring to FIGS. 17-21, locking mechanism 71 comprises a rocker bar 91, locking button 92, spring 93 and the plurality of holes defined in both an extendible wing section (such as 27) and a tube member of the corresponding bed section (such as tube member 30 of back section 12). Referring to arm 46 and tube member 30 (which is otherwise the same as or a mirror image of the other mating tube members and arms of bed frame 10), arm 46 defines a wing hole 96 (FIG. 20) in its outward side. In horizontal alignment therewith when assembled, the corresponding portion of tube member 30 defines at least two, and preferably four registration holes 61-64 that will align with wing hole 96 when left wing section 27 is in a desired laterally extended or retracted position. As such, the fully retracted position 51 corresponds to wing hole 96 being aligned with innermost hole 61; the fully extended position 52 corresponds to wing hole 96 being aligned with outermost hole 64; and first and second intermediate positions (not shown) correspond to wing hole 96 being aligned with intermediate holes 62 and 63, respectively. Arm 46 also defines an inwardly opening hole 97, near the corner junction 98 of arm 46 and its siderail 47.

Rocker bar 91 is an elongate bar defining at its inner end 100 a button hole 101 and having connected to its opposite, outer end 102 a knob 103. Approximately midway between ends 100 and 102, rocker bar 91 includes a pivot plate 105 that holds rocker bar 91 for pivoting movement generally about a vertical axis thereat, as shown. Pivot plate 105 is shaped and configured to slide into and rest within the hollow cavity 106 of arm 46 with enough clearance to facilitate its insertion and allow easy pivoting of rocker bar 91 inside of arm 46. This includes the width of pivot plate 105 being just slightly less than the interior width 104 of its arm 46 so that rocker bar 91 generally does not move laterally within its arm 46, but only pivots thereat. Pivot plate 105 includes nibs 108 at its upper and lower outer corners, which facilitates is movement within cavity 106. Rocker bar 91 is sized and shaped, relative to the hollow cavity 106 of tubular arm 46 and of pivot plate 105 to allow it to rock back and forth (generally about a vertical axis at pivot plate 105) to enable button 92 to move in and out of locking position through holes 96 and 61-64. In such position, knob 103 has a neck 107 that extends through the hole 97 of arm 46.

At its opposite end, rocker bar 91 defines a recess 108, leaving a thinner tab portion 109, in which is defined the button hole 101.

Spring 93 is a leaf spring having a first spring arm 110, a connecting head 111 and a second spring arm 112. In the present embodiment, locking button 92 is formed as a raised portion of the end of second spring arm 112, as shown. Alternative embodiments are contemplated wherein locking button 92 is a separate element connectable or engageable to operate in concert with spring 93 to function like the combined spring 93 and locking button 92 described herein. Alternative embodiments are contemplated wherein spring 93 is other than a leaf spring, so long as it biases locking button 92 into its intended holes and that such action is controllable by rocker bar 91.

In assembly, locking button 92 is inserted through button hole 101 so that second spring arm 112 lies against tab portion 109 and within recess 108, and the combination of spring 93, locking button 92 and rocker bar 91 are inserted into the inner end 114 of arm 46 (FIG. 21). When the outer end 115 of rocker bar 91 reaches hole 97 of arm 46, the neck 107 of knob 103 is passed through hole 97 and is connected as by a screw to the outer end 102 of rocker bar 91, as shown. In this position, locking button 92 will be positioned through button hole 101. With the similar locking mechanism 71 assembled to the opposing arm 45, arms 45 and 46 can be inserted into opposing ends 48 and 49 of tube members 29 and 30, and wing section 27 pushed inwardly. Simultaneously, outward depression of knobs 103 (that is, pushing the knob 103 at rear arm 46 rearwardly and pushing the knob 103 at forward arm 45 forwardly) will pivot or rock the corresponding rocker bars 91 and pull the locking buttons 92 inwardly, and out of whichever of holes 61-64 they were extending through and, while holding wing section 27 (which can be simultaneously, conveniently grasped by virtue of the positionment of the buttons 103 relative to the corner junctions 98), wing section 27 can be pulled (extended) or pushed (retracted) to its desired position.

The location and number of the holes 61-64 can be vary as desired. In one embodiment, holes 61-64 are positioned to correspond to bed frame widths of 35, 39, 42 and 48 inches, which corresponds to several standard mattress sizes.

Locking bed frame 12 in a particular position broadly means releasably locking one or more locking mechanisms to hold the corresponding wing section in position until the knob(s) 103 is(are) depressed to move the corresponding locking button(s) 92 out registry with its hole (61-64) and allow the wing section to be moved relative to its tube member.

While the invention is shown in use with articulating bed 70, alternative embodiments are contemplated wherein the variable width bed frame 10 and locking mechanism 71 are used with different beds and/or bed frames which have some or no articulating (bending, moving, pivoting, lifting, etc.) capability.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for varying the width of a health care bed, comprising the steps of:

providing a health care bed including:

a base frame and a bed frame connected thereto, the bed frame including at least two bed sections hingedly connected to each other and each having a central frame portion and left and right wing sections, the wing sections having at least a retracted position and an extended position relative to the central frame portion, and wherein the central frame portion defines, for each wing section, at least inner and outer registration holes and the wing sections each define at least one wing hole that aligns with one of the at least inner and outer registration holes when the wing sections are in the respective retracted and extended positions, and for each wing section, at least one locking mechanism having at least one rocker bar with opposing inner and outer ends, at least one spring and at least one locking button for releasably locking the corresponding wing section in the retracted and extended positions;

unlocking the at least one locking mechanism of one of the wing sections by pushing the outer end of its rocker bar to move the opposing inner end and one of the locking buttons out of engagement with a corresponding and then aligned registration hole and wing hole; and moving the one wing section to the desired extended or retracted position.

2. The method for varying the width of a health care bed of claim 1 wherein said providing step includes the central frame portion including tube members with ends and the left and right wing sections including arms that are telescopically received within corresponding ends of the tube members to move between the retracted and extended positions.

3. The method for varying the width of a health care bed of claim 2 wherein said providing step includes at least one arm of each wing section defining a cavity and having disposed therein one of the at least one rocker bars.

4. The method for varying the width of a health care bed of claim 3 wherein said providing step includes the at least one arm defining a wing hole; there being defined at least two registration holes in the end of at least one of the tube members; and one of the at least one locking buttons being positioned within the cavity of the at least one arm to retractably extend through both the wing hole and a corresponding one of the at least two registration holes to define and releasably lock each wing section in the retracted and extended positions.

5. The method for varying the width of a health care bed of claim 4 wherein said providing step includes one of the at least one springs being positioned within each cavity to bias a corresponding one of the at least one locking buttons through its wing hole and registration hole.

6. The method for varying the width of a health care bed of claim 5 wherein said providing step includes each rocker bar having an inner end engaged with a corresponding locking button to move such corresponding locking button, against the bias of its corresponding spring, out of any corresponding registration hole.

7. The method for varying the width of a health care bed of claim 6 wherein said providing step includes each rocker bar including an outer end accessible outside of its cavity and a pivot plate between the outer and inner ends, the rocker bar and its pivot plate being sized and configured relative to the cavity in which it is disposed so that manually pushing the outer end pivots the rocker bar about its pivot plate to move the inner end and thus the locking button engaged therewith out of any corresponding registration hole.

8. The method for varying the width of a health care bed of claim 3 wherein said providing step includes each wing section having two of the at least one locking mechanisms with the cavity of each arm having disposed therein one of the at least one rocker bars.

9. The method for varying the width of a health care bed of claim 1 wherein said providing step includes the at least two bed sections including a back section, a seat section, and at least one leg section.

10. A method for varying the width of a health care bed, comprising the steps of:

providing a health care bed including a base frame and a bed frame connected thereto, the bed frame including at least two bed sections connected to each other and each bed section having a central frame portion and left and right wing sections having at least a retracted position and an extended position relative to its central frame portion, and for each wing section, the health care bed further including at least one locking mechanism with at least one rocker bar, at least one spring and at least one locking button for releasably locking the wing sections in the retracted and extended positions;

unlocking the at least one locking mechanism of one of the wing sections by pushing its rocker bar, against the bias of its spring, to move its locking button out of engagement with its central frame portion; and moving the one wing section to the desired extended or retracted position.

11. The method for varying the width of a health care bed of claim 10 wherein said providing step includes the central frame portion defining, for each wing section, at least inner and outer registration holes and the wing sections each defining at least one wing hole that aligns with one of the at least inner and outer registration holes when the wing sections are in the respective retracted and extended positions.

12. The method for varying the width of a health care bed of claim 11 wherein said providing step includes the at least two bed sections being hingedly connected to each other.

13. The method for varying the width of a health care bed of claim 12 wherein said providing step includes the central frame portion including tube members with ends and the left and right wing sections including arms that are telescopically received within corresponding ends of the tube members to move between the retracted and extended positions.

14. The method for varying the width of a health care bed of claim 13 wherein said providing step includes at least one arm of each wing section defining a cavity and having disposed therein one of the at least one rocker bars.

15. The method for varying the width of a health care bed of claim 14 wherein said providing step includes the at least one arm defining a wing hole; there being defined at least two registration holes in the end of at least one of the tube members; and one of the at least one locking buttons being positioned within the cavity of the at least one arm to retractably extend through both the wing hole and a corresponding one of the at least two registration holes to define and releasably lock each wing section in the retracted and extended positions.

16. The method for varying the width of a health care bed of claim 15 wherein said providing step includes one of the at least one springs being positioned within each cavity to bias a corresponding one of the at least one locking buttons through its wing hole and registration hole.

17. The method for varying the width of a health care bed of claim 16 wherein said providing step includes each rocker bar having an inner end engaged with a corresponding locking button to move such corresponding locking button, against the bias of its corresponding spring, out of any corresponding registration hole.

18. The method for varying the width of a health care bed of claim 17 wherein said providing step includes each rocker bar including an outer end accessible outside of its cavity and a pivot plate between the outer and inner ends, the rocker bar and its pivot plate being sized and configured relative to the cavity in which it is disposed so that manually pushing the outer end pivots the rocker bar about its pivot plate to move the inner end and thus the locking button engaged therewith out of any corresponding registration hole.

19. The method for varying the width of a health care bed of claim 14 wherein said providing step includes each wing section having two of the at least one locking mechanisms with the cavity of each arm having disposed therein one of the at least one rocker bars.

20. The method for varying the width of a health care bed of claim 10 wherein said providing step includes the at least two bed sections including a back section, a seat section, and at least one leg section.

* * * * *